United States Patent [19]

Dan et al.

[11] Patent Number: 4,837,102

[45] Date of Patent: Jun. 6, 1989

[54] LIQUID DEVELOPER FOR ELECTROSTATIC PHOTOGRAPHY

[75] Inventors: Shigeyuki Dan; Eiichi Kato; Kazuo Ishii; Hiroshi Ishibashi; Hidefumi Sera, all of Shizuoka, Japan

[73] Assignee: Fuji Photo Film Co., Ltd., Kanagawa, Japan

[21] Appl. No.: 94,612

[22] Filed: Sep. 9, 1987

[30] Foreign Application Priority Data

Sep. 9, 1986 [JP] Japan ..... 61-212392
Sep. 9, 1986 [JP] Japan ..... 61-212393

[51] Int. Cl.[4] ..... G03G 9/12

[52] U.S. Cl. ..... 430/114; 430/115; 430/137; 430/904

[58] Field of Search ..... 430/114, 115, 137, 904

[56] References Cited

U.S. PATENT DOCUMENTS 4,618,557 10/1986 Dan et al. ..... 430/114
4,665,002 5/1987 Dan et al. ..... 430/114

FOREIGN PATENT DOCUMENTS 206606 12/1986 European Pat. Off. .

*Primary Examiner*—J. David Welsh
*Attorney, Agent, or Firm*—Sughrue, Mion, Zinn, Macpeak & Seas

[57] ABSTRACT

A liquid developer for electrostatic photography comprising a carrier medium having an electrical resistivity of not less than $10^9$ 106.cm and a dielectric constant of not more than 3.5 having dispersed therein at least a resin, wherein said resin is a copolymer resin obtained by copolymerizing (1) a solution containing at least one copolymer having an unsaturated bond obtained by copolymerizing at least one monomer (A) represented by formula (I) shown below and at least one monomer (B) represented by formula (II) shown below, and reacting the resulting copolymer with at least one monomer (C) represented by formula (III) shown below, (2) at least one monomer (D) which is soluble in the carrier medium but becomes insoluble upon polymerization, and (3) at least one monomer (E) represented by formula (IV) shown below to obtained a resin dispersion:

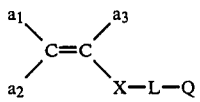
(I)

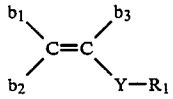
(II)

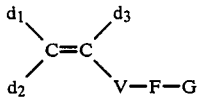
(III)

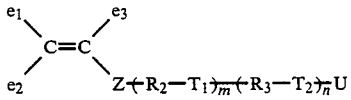
(IV)

wherein $a_1$, $a_2$, $a_3$, $b_1$, $b_2$, $b_3$, $d_1$, $d_2$, $d_3$, $e_1$, $e_2$, $e_3$, X, Y, V, Z, L, F, Q, G, $R_1$, $R_2$, $R_3$, $T_1$, $T_2$, U, m and n are defined in the specification. The developer is excellent in redispersibility, preservability, stability, image reproducibility, and fixing properties and is capable of producing a master plate for offset printing having excellent printing durability.

19 Claims, No Drawings

LIQUID DEVELOPER FOR ELECTROSTATIC PHOTOGRAPHY

FIELD OF THE INVENTION

The present invention relates to a liquid developer for electrostatic photography comprising a carrier medium having an electrical resistivity of not less than $10^9$ Ω.cm and a dielectric constant of not more than 3.5 having dispersed therein at least one resin. More particularly, the present invention relates to a liquid developer for electrostatic photography that is excellent with respect to redispersibility, preservability, stability, image reproducibility, and fixing properties.

BACKGROUND OF THE INVENTION

Conventional liquid developers for electrophotography generally comprise a liquid medium having high insulating properties and low dielectric constants, such as petroleum aliphatic hydrocarbons, having dispersed therein organic or inorganic pigments or dyes, e.g., carbon black, nitrosine, phthalocyanine blue, etc., and natural or synthetic resins, e.g., alkyd resins, acrylic resins, rosine, synthetic rubbers, etc., and further containing therein a polarity regulator, such as metallic soaps, lecithin, linseed oil, higher fatty acids, polymers containing vinylpyrrolidone, etc. In these liquid developers, resins are dispersed as insoluble latex particles having a diameter of from several to several hundred micro-meters. However, since bonding between soluble resins for dispersion stability or polarity regulators and the insoluble latex particles is insufficient in such conventional developers; thus, the soluble resins and regulators are apt to diffuse into the solution. As a result, the soluble resins for dispersion stability become separated from the insoluble latex particles during long-term preservation or repeated use, causing sedimentation, aggregation or accumulation of the particles or adversely affecting polarity. These aggregated or accumulated particles are difficult to redisperse in the medium, and they adhere to various parts of a developing machine, which leads to stains on image areas or causes problems with respect to operation of developing machines, such as clogging the feed pump, and the like.

In order to overcome these disadvantages, it has been proposed to chemically bind the soluble resins for dispersion stability and the insoluble latex particles as disclosed, e.g., in U.S. Pat. No. 3,990,980. However, this technique is very likely to produce particles having two or more peaks in a size distribution curve or a broad distribution, thus the inherent difficulty in obtaining particles having a controlled size occurs. In addition, the resulting developer has poor reproducibility.

Japanese patent application (OPI) No. 63855/86 (the term "OPI" as used herein means an "unexamined published application") discloses means proposed to eliminate the problems associated with the above-mentioned U.S. Patent. However, although the particles prepared in accordance with this disclosure have satisfactory mono-dispersibility, redispersibility, and stability as to preservation, it has still been demanded to further improve printing durability, and particularly on large-sized printing sheets.

A method of obtaining colored toner particles by the above-mentioned polymerization granulation technique is disclosed in Japanese patent application (OPI) No. 52588/78. This method comprises adding dropwise a solution comprising a monomer which is soluble in a non-polar solvent but becomes insoluble upon polymerization, a dye which is soluble in a monomer and insoluble in the non-polar solvent, and a polymerization initiator to a non-polar solvent containing a charge control agent, etc. to effect a polymerization reaction. According to this method, the dropwise addition of the solution simultaneously induces dissolving of the monomer in the non-polar solvent to thereby form fine crystals of the dye. Thereafter, the monomer is polymerized to obtain a liquid developer in which the resulting polymer is adsorbed onto the fine crystals of the dye.

However, the above-described method involves a serious problem as set forth below. A number of dyes have a chemical structure in which a radical, e.g., a phenolic hydroxyl group, a phenylamino group, or a nitrophenyl group, can stably exist. Most of the dyes having such a chemical structure function as a substance which inhibits radical polymerization of monomers, and are known as radical polymerization inhibitors. Therefore, presence of such dyes in the system employed for radical polymerization of monomers as described above interferes with the polymerization reaction, resulting in an entire failure of, in extreme cases, adsorption of a polymer onto the fine crystals of the dye. Accordingly, the dyes which can be used in this method should satisfy both requirements that they do not act as a radical polymerization inhibitor and that they are insoluble in non-polar solvents but soluble in a resinous monomer to be polymerized. Hence, the choice of materials for the dyes and monomers to be used is quite limited, and many dyes virtually cannot serve the purposes of this method. Further, dispersion stability of the particles prepared by these polymerization granulation methods are too poor to be applied to practical use.

SUMMARY OF THE INVENTION

One object of the present invention is to solve the above-described problems associated with conventional liquid developers and to provide a liquid developer for electrostatic photography which is free from deterioration in redispersibility and stability during long-term preservation or repeated use.

Another object of the present invention is to provide a liquid developer having a uniform particle size and excellent image reproducibility.

Still another object of the present invention is to provide a liquid developer which does not cause development apparatus problems, such as clogging of a free pump, or image stains due to long-term repeated use.

A further object of the present invention is to provide a liquid developer whose polarity is not subject to variation and which always reproduces a distinct image.

A still further object of the present invention is to provide a liquid developer which has satisfactory fixing properties to form a stable image.

A yet further object of the present invention is to provide a liquid developer which produces an image having excellent durability in printing on a large-sized sheet.

These and other objects of the present invention can be satisfied by a liquid developer for electrostatic photography comprising a carrier medium having an electrical resistivity of not less than about $10^9$ Ω.cm and a dielectric constant of not more than about 3.5 having dispersed therein at least a resin, wherein the resin is a copolymer resin obtained by: copolymerizing (1) a solution containing at least one copolymer having an unsaturated bond obtained by copolymerizing at least one monomer (A) represented by formula (I) shown below and at least one monomer (B) represented by formula (II) shown below, and reacting the resulting copolymer with at least one monomer (C) represented by formula (III) shown below, (2) at least one monomer (D) which is soluble in the carrier medium but becomes insoluble upon polymerization, and (3) at least one monomer (E) represented by formula (IV) shown below to obtain a resin dispersion.

Formulae (I) to (IV) are represented by:

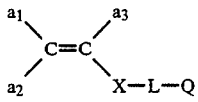
(I)

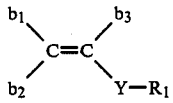
(II)

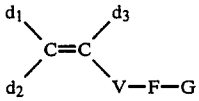
(III)

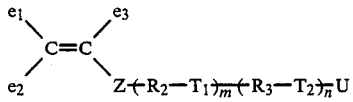
(IV)

wherein $a_1$, $a_2$, $a_3$, $b_1$, $b_2$, $b_3$, $d_1$, $d_2$, $d_3$, $e_1$, $e_2$, and $e_3$, which may be the same or different, each represents a hydrogen atom, a hydrocarbon group, $—CO_2J$ or $—CH_2CO_2J$, wherein J represents a hydrogen atom or a hydrocarbon group; X, Y, V and Z, which may be the same or different, each represents —O—, —S—, —CO—, $—CO_2—$, —OCO—, $—SO_2—$, $—CH_2OCO—$, —CONH—, $—SO_2NH—$, —NHCO—, —NHCONH—, $$—\underset{\underset{W}{|}}{CON}— \text{ or } —\underset{\underset{W}{|}}{SO_2N}—,$$

wherein W represents a hydrocarbon group or $-(R_2—T_1)_m(R_3—T_2)_nU$; L and F, which may be the same or different, each represents a hydrocarbon group or a chemical bond linking X and Q, or V and G, respectively, either directly or via a hetero atom; Q and G, which may be the same or different, each represents a group selected from $—CO_2H$,

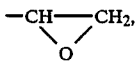

—COCl, —OH, $—NH_2$, $—NHR_4$, wherein $R_4$ represents a hydrocarbon group, or —NCO, Q and G thus being capable of forming a chemical bond upon reaction; $R_1$ represents a hydrocarbon group having from 4 to 20 carbon atoms; U represents a hydrogen atom, an unsubstituted hydrocarbon group having up to 18 carbon atoms or a hydrocarbon group having up to 18 carbon atoms which may be substituted with a halogen atom, —OH, —CN, $—NH_2$, $—CO_2H$, $—SO_3H$ or $—PO_3H$; $T_1$ and $T_2$, which may be the same or different, each represents —O—, —S—, —CO—, $—CO_2—$, —OCO—, $—SO_2—$, $$—\underset{\underset{U_1}{|}}{N}—,\ —\underset{\underset{U_2}{|}}{CON}—,\ —\underset{\underset{U_3}{|}}{NCO}—,\ —\underset{\underset{U_4}{|}}{NSO_2}—,\ —\underset{\underset{U_5}{|}}{SO_2N}—,$$

$—NHCO_2—$ or —NHCONH—, wherein $U_1$, $U_2$, $U_3$, $U_4$, and $U_5$ each has the same meaning as U; $R_2$ and $R_3$, which may be the same or different, each represents a hydrocarbon group having up to 18 carbon atoms which may be substituted with a halogen atom, —OH, $—NH_2$, —COOH, $—SO_3H$, —CN or —NCO and which may contain in its main chain a group —CH—, wherein $T_3$ and $T_4$, which may be the same or different, $T_3-(R_5—T_4)_pU_6$ each has the same meaning as $T_1$ and $T_2$; $R_5$ represents a hydrocarbon group having up to 18 carbon atoms which may be substituted with a halogen atom, —OH, $—NH_2$, —COOH, $—SO_3H$, —CN or —NCO; $U_6$ has the same meaning at U; and p represents 0 or an integer of from 1 to 4; and m and n each represents 0 or an integer of from 1 to 4.

The liquid developer according to the present invention may be characterized, in one aspect, by using the monomer (E) represented by formula (IV) in forming the resin dispersion. Introduction of this monomer component to the resin dispersion contributes to production of a liquid developer which forms an image excellent in printing durability.

DETAILED DESCRIPTION OF THE INVENTION

The carrier medium having an electrical resistivity of not less than $10^9$ Ω·cm and a dielectric constant of not more than 3.5 which can be used in the present invention includes straight chain or branched aliphatic, alicyclic or aromatic hydrocarbons, or halogen-substituted derivatives thereof and mixtures thereof. Specific examples of such media are octane, isooctane, decane, isodecane, decalin, nonane, dodecane, isododecane, and isoparaffin type solvents which are commercially available under tradenames of Isoper E, G, H or L (products of Exson Co.), Shellsol 70 to 71 (products of Shell Oil Co.), Amsco OMS or 460 (products of American Mineral Spirits Co.), etc.

The insoluble latex particles according to the present invention are prepared by so-called polymerization granulation using soluble resins for dispersion stability. Solvents to be used in the polymerization reaction may be any of those miscible with the above-described carrier medium, and include straight chain or branched aliphatic, alicyclic or aromatic hydrocarbons, or halogen-substituted derivatives thereof, and mixtures thereof. Specific examples of the solvents are octane, isooctane, decane, isodecane, decalin, nonane, dodecane, isododecane, and isoparaffin type solvents which are commercially available under tradenames of Isoper E, G, H or L, Shellsol 70 or 71, Amsco OMS or 460 etc.

Insoluble latex particles can be produced stably in the above-described non-aqueous solvent in the presence of at least one soluble resin for dispersion stability which is synthesized from the aforesaid monomers (A), (B) and (C). Solvents suitably used for synthesizing the soluble resin for dispersion stability are not particularly restricted. However, the solvent is desirably selected from among those which are compatible with the solvent to be used in the subsequent polymerization granulation so that the resulting resin may be used without removing the solvent used. Examples of such solvents are straight chain or branched aliphatic, alicyclic or aromatic hydrocarbons, or halogen-substituted derivatives thereof, and mixtures thereof.

Since the monomer (B) represented by formula (II) serves to impart solubility to the resin, it is preferably selected from among those wherein $R_1$ contributes to miscibility with the carrier medium having an electrical resistivity of not less than $10^9$ Ω·cm and a dielectric constant of not more than 3.5. Examples of such a monomer include esters of acrylic acid or methacrylic acid with an alkyl group, e.g., an octyl group, a decyl group, a dodecyl group, a tetradecyl group, a hexadecyl group, an octadecyl group, a 2-ethylhexyl group, etc.; and esters of acrylic acid or methacrylic acid with an alkenyl group, e.g., an octenyl group, a decenyl group, an octadecenyl group, an oleyl group, etc.

The monomer (A) represented by formula (I) includes unsaturated carboxylic acids (e.g., acrylic acid, methacrylic acid, maleic acid, fumaric acid, crotonic acid, etc.) or chlorides thereof (e.g., acryl chloride, methacryl chloride, crotonyl chloride, etc.), unsaturated alcohols (e.g., allyl alcohol, etc.), unsaturated amines (e.g., allylamine, etc.), and a glycidyl ester, hydroxypropyl ester or hydroxyethyl ester of acrylic acid or methacrylic acid, and so on.

The monomer (C) represented by formula (III) can be selected from the specific examples recited above for the monomer (A), but should be different from the monomer (A) and be selected so that the moiety G in formula (III) may easily form a chemical bond with the moiety Q of the monomer (A) upon reaction, such as a condensation reaction, an addition reaction, and the like. For example, in the case of using the monomer (A) wherein Q is $—CO_2H$, the monomer (C) is selected from those wherein G is —OH,

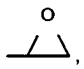

$—NH_2$ or $—NHR_4$, wherein $R_4$ is as defined above. In the case where the moiety Q in the monomer (A) is —OH, the monomer (C) is selected from those wherein G is $—CO_2H$, —COCl or —NCO. Selection of these and other combinations of the moieties Q and G can be easily made by one skilled in the field of organic chemistry.

In the copolymerization according to the present invention, the soluble copolymer resin containing an unsaturated bond can be prepared from the above-described monomer components as follows. The monomers (A) and (B) are dissolved in a suitable solvent (as described above), and the solution is heated at a temperature of from about 50° to about 200° C. for 2 to 12 hours in the presence of a polymerization initiator, for example, azobisisobutyronitrile and benzoyl peroxide. The monomer (C) and, if desired, a known polymerization inhibitor commonly employed in a polymerization system, are added to the reaction mixture, followed by heating at the same temperature for an additional 2 to 48 hours. If desired according to the reaction mode, a catalyst, e.g., lauryldimethylamine, may be present in the heating system. The molar ratio of monomer (A) to monomer (B) preferably ranges from about 50:50 to about 0.5:99.5, and the molar ratio of monomer (A) to monomer (C) preferably ranges from about 2:3 to about 2:1. The amount of the polymerization inhibitor, if used, is from 0.01 to 1 g per liter of the solvent. The thus prepared soluble copolymer having an unsaturated bond has a molecular weight of from about 5,000 to about 500,000.

Specific examples of the soluble copolymer resin for dispersion stability having an unsaturated bond are shown below for illustrative purposes only, but are not to be construed as limiting the scope of the present invention in any manner:

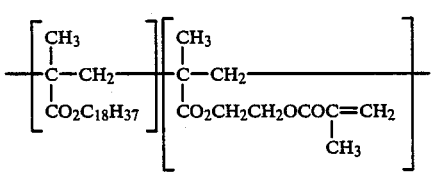

(i)

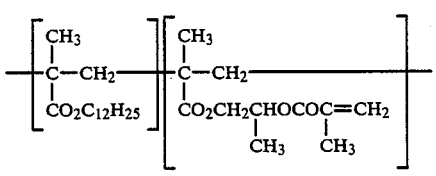

(ii)

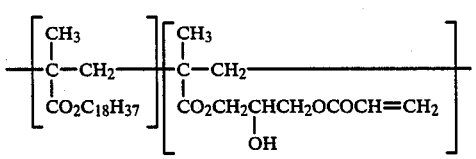

(iii)

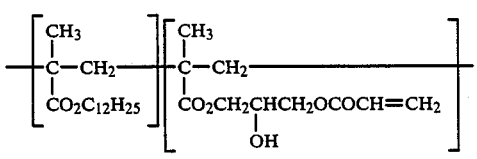

(iv)

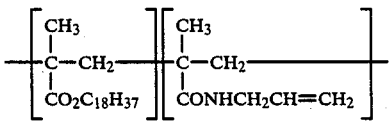

(v)

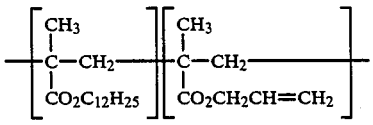

(vi)

-continued (vii)

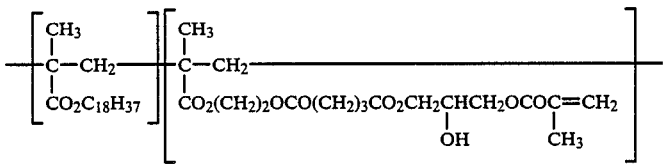

(viii)

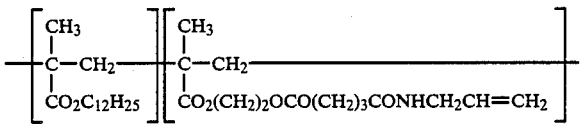

(ix)

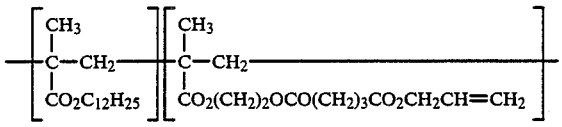

(x)

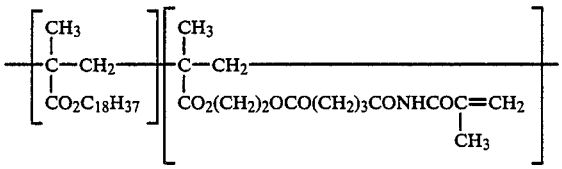

(xi)

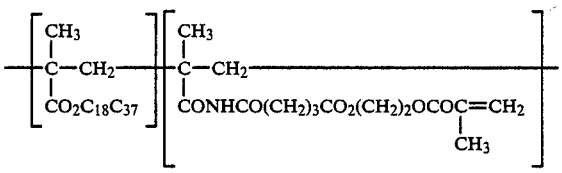

(xii)

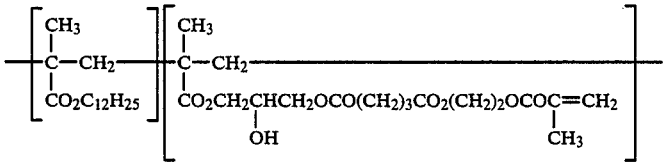

The monomer (D) is soluble in the above-described carrier medium and non-aqueous solvent but becomes insoluble upon polymerization, and includes alkyl esters of unsaturated carboxylic acids (e.g., acrylic acid, methacrylic acid, crotonic acid, itaconic acid, maleic acid, etc.) having from 1 to 3 carbon atoms in the alkyl moiety thereof; vinyl esters or allyl esters of aliphatic carboxylic acids having from 1 to 3 carbon atoms; unsaturated carboxylic acids (e.g., acrylic acid, methacrylic acid, crotonic acid, maleic acid, itaconic acid, etc.) or anhydrides thereof; 2-hydroxyethyl acrylate or methacrylate; N-vinylpyrrolidone; acrylonitrile; vinyl ethers, and the like.

In formula (IV) representing the monomer (E), Z preferably represents —O—,—COO—, —OCO—, —$CH_2$OCO—, —CONH— or

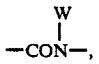

wherein W represents a substituted or unsubstituted alkyl group having from 1 to 16 total carbon atoms, a substituted or unsubstituted alkenyl group having from 2 to 16 total carbon atoms, a substituted or unsubstituted alicyclic group having from 5 to 18 total carbon atoms or a group $-(R_2-T_1)_m(R_3-T_2)_nU$ where the substituents for the alkyl, alkenyl and alicyclic groups include a halogen atom, —OH, —$NH_2$, —COOH, —$SO_3H$, —CN and —NCO. U preferably represents a hydrogen atom or an aliphatic group having up to 16 carbon atoms (e.g., an alkyl group, an alkenyl group and an aralkyl group) which may be substituted with a halogen atom (e.g., a chlorine atom, a bromine atom, etc.), —OH, —CN or —COOH. $T_1$ and $T_2$ each preferably represents —O—, —S—, —CO—, —COO—, —OCO—,

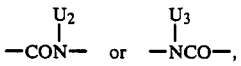

wherein $U_2$ and $U_3$ each has the same meaning as U as defined above. $R_2$ and $R_3$ each preferably represents a hydrocarbon group having up to 12 carbon atoms (e.g., an alkyl group, an alkenyl group, an aralkyl group, and an alicyclic group) which may be substituted with a halogen atom, —OH, —$NH_2$, —COOH, —$SO_3H$, —CN or —NCO, and which may contain in its main chain a group $$-\underset{\displaystyle T_3\leftarrow R_5-T_4\rightarrow_p U_6}{\underset{|}{CH}}-.$$

$T_3$ and $T_4$ each preferably has the same meaning as $T_1$ and $T_2$ as defined above. $R_5$ preferably represents an alkylene group, an alkenylene group or an aralkylene group having up to 12 carbon atoms. $U_6$ has the same meaning as U as defined above. $e_1$, $e_2$ and $e_3$ each preferably represents a hydrogen atom, a methyl group, $-CO_2J$ or $-CH_2CO_2J$, wherein J represents a hydrogen atom, an alkyl group, an alkenyl group, an aralkyl group or a cycloalkyl group having up to 18 carbon atoms. m, n and p, which may be the same or different, each preferably represents 0 or an integer of from 1 to 3.

More preferred of the monomer (E) are those wherein Z represents —COO—, —CONH— or $$-\overset{\displaystyle W}{\overset{|}{CON}}-;$$

$e_1$, $e_2$ and $e_3$ each represents a hydrogen atom, a methyl group, $-CO_2J$ or $-CH_2CO_2J$, wherein J represents an alkyl group having from 1 to 12 carbon atoms; $R_2$ and $R_3$ each represents a grop selected from $$-\overset{\displaystyle R'}{\underset{\displaystyle R''}{\overset{|}{\underset{|}{C}}}}-$$

(wherein R′ and R″, which may be the same or different, each represents a hydrogen atom, an alkyl group, a halogen atom, etc.),

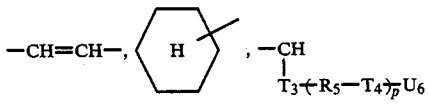

(wherein $T_3$, $T_4$, $U_6$, $R_5$ and p are as defined above), etc.; $T_1$, $T_2$, m, n and p are as defined above; and the total number of carbon atoms contained in Z, $R_2$, $T_1$, $R_3$, $T_2$ and U is 8 or more.

Specific non-limitative examples of the monomer (E) are shown below:

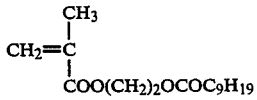
(1)

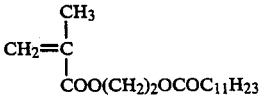
(2)

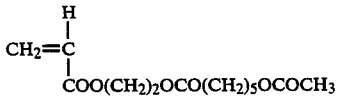
(3)

-continued

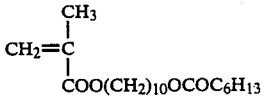
(4)

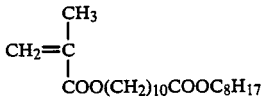
(5)

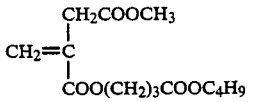
(6)

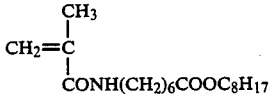
(7)

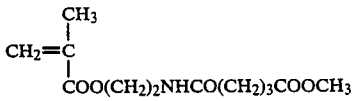
(8)

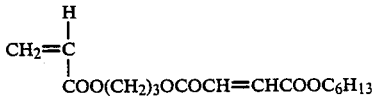
(9)

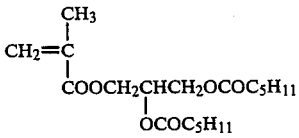
(10)

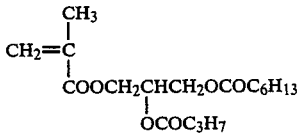
(11)

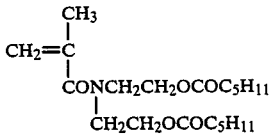
(12)

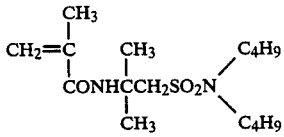
(13)

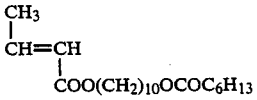
(14)

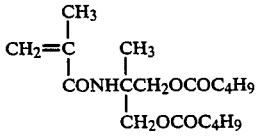
(15)

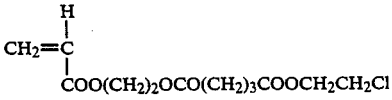
(16)

-continued $$CH_2{=}CH \quad (17)$$
$$|$$
$$OCO(CH_2)_{10}OCOC_3H_7$$

The resin dispersion according to the present invention can be prepared by dissolving at least one monomer (D), at least one monomer (E), and at least one of the copolymers having an unsaturated bond obtained from the monomers (A), (B) and (C) in the aforesaid non-aqueous solvent and heating the solution at a temperature of from about 50° to about 200° C. for 2 to 10 hours, if desired, in the presence of a known polymerization initiator commonly employed in a polymerization system, such as azobisisobutyronitrile, benzoyl peroxide, etc.

If necessary, a conventional dispersion stabilizer or a mixture thereof may be used during the polymerization reaction. The dispersion stabilizers suitably used in combination include various synthetic and natural resins soluble in non-aqueous solvents. Examples of these soluble resins include homo- or copolymers of monomers selected from esters of acrylic acid or methacrylic acid having an alkyl chain containing from 4 to 30 carbon atoms which may be substituted by, e.g., a halogen atom, a hydroxyl group, an amino group, an alkoxy group, etc., or may contain in its main chain a hetero atom (e.g., an oxygen atom, a sulfur atom, a nitrogen atom, etc.); fatty acid vinyl esters; alkyl vinyl ethers; olefins, e.g., butadiene, isoprene, diisobutylene, etc.; and the like. Copolymers obtained by copolymerizing a monomer which is soluble in the above-recited non-aqueous solvents with one or more comonomers described hereinafter, at such a copolymerization ratio that the resulting copolymer may be soluble in the above recited non-aqueous solvents, can also be used as dispersion stabilizers. Specific examples of such comonomers are vinyl acetate; a methyl, ethyl, n-propyl or iso-propyl ester of acrylic acid, methacrylic acid or crotonic acid; styrene and derivatives thereof (e.g., vinyltoluene, α-methylstyrene, etc.); an unsaturated carboxylic acid (e.g., acrylic acid, methacrylic acid, crotonic acid, maleic acid, itaconic acid, etc.) or an anhydride thereof; and monomers having various polar groups (e.g., a hydroxyl group, an amino group, an amido group, a cyano group, a sulfo group, a carbonyl group, a halogen atom, a heterocyclic ring, etc.), such as hydroxyethyl methacrylate, hydroxyethyl acrylate, diethylaminoethyl methacrylate, N-vinylpyrrolidone, acrylamide, acrylonitrile, 2-chloroethyl methacrylate, 2,2,2-trifluoroethyl methacrylate, etc.

In addition to the above-described synthetic resins, natural resins, such as alkyd resins, alkyd resins modified by various fatty acids, linseed oil, modified polyurethane resins, etc., may also be used as dispersion stabilizers.

The monomer or monomers (D) is or are used in a total amount of from about 5 to about 80 parts by weight, and preferably from 10 to 50 parts by weight, per 100 parts by weight of the non-aqueous solvent (reaction solvent). The monomer or monomers (E) is or are used in a total amount of from about 0.1 to about 50 mol%, and preferably from 0.5 to 10 mol%, based on the total mols of the monomer(s) (D). The resin or resins for dispersion stability is or are used in a total amount of from about 1 to about 100 parts by weight, and preferably from 5 to 50 parts by weight, per 100 parts by weight of the total monomers. The amount of the polymerization initiator, if used, suitably ranges from about 0.1 to about 5 parts by weight per 100 parts by weight of the total monomers.

The thus prepared non-aqueous dispersion resin has a uniform and narrow particle size distribution, and can be controlled easily to have a desired particle size. The insoluble resin particles according to the present invention exhibit very satisfactory redispersibility, stability, and fixing properties. Even when they are preserved or stored for a long period of time, or when repeatedly used in a developing machine, cause much less sedimentation, aggregation or adhesion in or onto the vessel or various parts of the apparatus than conventional liquid developer. Further, when these particles are fixed upon heating, or similar means, a stable film can be formed to provide a durable image.

If desired, a colorant may be used in the present invention. Suitable colorants are not particularly restricted, and include various known pigments and dyes. The colorant may be dispersed individually in the non-aqueous solvent in the presence of a dispersion accelerator and the like, or a polymer may be chemically bonded to the surface of the colorant to form grafted particles (e.g., "Graft Carbon" produced by Mitsubishi Gas Chemical Ind., Ltd.). Further, the colorant may be incorporated into the insoluble resin particles. Coloration of the insoluble resin can be carried out by, for example, a known method comprising physically dispersing a pigment or dye in the resin by means of a dispersing apparatus, e.g., a paint shaker, a colloid mill, a vibrating mill, a ball mill, etc., as described, e.g., in Japanese Patent Application (OPI) No. 75242/73. A number of pigments and dyes are used for this purpose, such as magnetic iron oxide powders, carbon black, Nigrosine, Alkali Blue, Hansa Yellow, Quinacridone Red, Phthalocyanine Blue, Benzidine Yellow, etc.

Coloration can also be effected by a method of dyeing the insoluble resin with a desired dye by heating as described in Japanese Patent Application (OPI) No. 48738/82. According to this method, at least one organic dye and, if desired, a second solvent compatible with the non-aqueous solvent, capable of dissolving the dye, and capable of at least swelling the resin particles, are added to the resin dispersion, and the system is heated.

One of methods for coloring the resin is a physical dyeing method, in which a dye sparingly soluble or insoluble in the non-aqueous solvent and capable of dissolving monomers constituting the copolymer, is used under heat with or without the aforesaid second solvent. It is assumed that the dye used is impregnated in or adhered on the copolymer particles to effect dyeing. Therefore, it is preferred to choose the most suitable dye according to the constituent components of the copolymer resin. Suitable dyes which can be used for dyeing polyester resins, polyacrylic resins, polyacrylonitrile resins, etc. include known disperse dyes and basic dyes. Specific examples of the disperse dyes are Celliton Fast Yellow RR, Celliton Fast Rubine 3B, and Celliton Fast Scarlet R (products of BASF); Kayalon Fast Yellow G, Kayalon Fast Brown R, Kayalon Fast Scarlet B, Kayalon Fast Rubine B, Kayalon Fast Red R, Kayalon Fast Violet BB, Kayalon Fast Blue FN, and Kayalon Fast Blue Green B (products of Nippon Kayaku Co., Ltd.); Miketone Fast Pink FR, and Miketone Fast Violet BB (products of Mitsui Chemical Co., Ltd.); and Sumikaron Yellow FG, Sumikaron Blue BR, and Sumikaron Navy Blue R (products of Sumitomo Chemical Co., Ltd.). Specific examples of the basic dyes are Flavine 8G; Auramine; Crystal Violet; Methylene Blue; Rhodamine 6G; Malachite Green; Sumiacryl Yellow 3G, Sumiacryl Yellow 3R, Sumiacryl Orange G, and Sumiacryl Orange R (products of Sumitomo Chemical Co., Ltd.); Aizen Cathilon Pink, Aizen Cathilon Red 6BH, and Aizen Basic Cyanine 6GH (products of Hodogaya Chemical Co., Ltd.); Primocyanine BX; etc. The dyes described in M. Iizuka, Senshoku Kogyo, Vol. 13, 429–448 (1965) may also be used.

The second solvent which is miscible with non-polar solvents and capable of dissolving the dye and swelling the resin particles preferably includes at least one of the monomers (A) to (E) constituting the copolymer resin of the present invention, preferably monomer (D). Use of these monomers as a second solvent is advantageous in that they do not cause adverse effects, such as aggregation of resin particles, as observed when using other types of solvents. It is also possible to use solvents other than these monomers which satisfy the above-described conditions, e.g., ethanol, acetone, ethyl acetate, etc., with the amount to be used being controlled as necessary.

The second solvent is not needed when the resin dispersion obtained by polymerization granulation retains a sufficient amount of residual monomers. In the case where the amount of residual monomers is insufficient, it is necessary to add the aforesaid second solvent to the dispersion in an amount of at least about 1/10 the weight of the resin particles in the dispersion.

The second solvent may be added to the resin dispersion as a solution having a dye dissolved therein. Otherwise, the dye may be added to the dispersion in the form of a powder, and the second solvent may be added either before or after the addition of the dye. In any event, it is required that the resin dispersion contains the dye and the second solvent in the following stage where the second solvent is removed. Addition of the dye and the second solvent to the dispersion may not be necessarily completed before the stage of removing the second solvent. That is, for example, the resin dispersion can be replenished with the dye and/or second solvent while removing the second solvent.

The amount of the second solvent ranges from about 0.1 to about 10 times the weight of the resin particles, but preferably does not exceed about $\frac{1}{3}$ the volume of the resin dispersion taking into consideration the subsequent removal of the solvent. However, this preferred range is not limitative, and a broader range may be permissible depending on the kind of the dye, resin particles, non-aqueous solvent, and second solvent.

The second solvent in the dispersion is then removed either while the dye and the second solvent are added thereto dropwise and mixed, or after the addition is completed. The second solvent removal can be effected under reduced pressure and, if desired, under heating.

The amount of the dye to be used is at least about 0.5% by weight based on the resin particles in the dispersion. Amounts not less than 3% by weight are preferred to ensure satisfactory color density. The upper limit of the dye amount is not particularly limited, but is usually about 20% by weight.

Heating for dyeing reaction is carried out at a temperature ranging from about 40° to about 150° C., and preferably from 80° to 120° C., for a period of from about 0.5 to about 12 hours, and preferably from 1 to 5 hours.

Another method for dyeing the dispersed resin is a mordanting method utilizing an ionic bond between an acid group and a basic group. According to this method, dyeing is effected with basic dyes, i.e., cationic dyes, in cases where at least one component constituting the dispersed resin particles contains an acid group, e.g., a carboxyl group; or with acid dyes in cases where at least one component constituting the particles contains a basic group.

The basic dyes which can be used for resin particles comprising a copolymer containing a carboxyl group or a sulfo group include the above-enumerated specific examples of basic dyes and, in addition, Aizen Victoria Blue BH, Aizen Victoria Pure Blue BOH, Aizen Cathilon Grey BLH, and Aizen Cathilon Black GH (products of Hodogaya Chemical Co., Ltd.).

Acid dyes suitably used for resin particles comprising a copolymer containing a basic group are dyes containing a carboxyl group or a sulfo group, e.g., Kiton Blue A (CIBA), Alizarine Astrol B (Ikeda Chemical K.K.), Kayanol Blue N2G (Nippon Kayaku Co., Ltd.), Suminol Fast Sky Blue B (Sumitomo Chemical Co., Ltd.), Alizarine Light Brown BL (Mitsubishi Chemical Ind., Ltd.), Aizen Eosine GH (Hodogaya Chemical Co., Ltd.), and Alizarinol R (Yamada Chemical Co., (Ltd.). These acid dyes may be used either in the form of a free acid or in the form of a metal salt, a salt with an organic base or a quaternary ammonium salt.

The amounts of reactants, etc., and dyeing conditions employed in the mordanting method are the same as those for the above-described physical dyeing method.

A still further method for dyeing is a method of chemically bonding the resin and a dye. For example, the resin and a dye can be reacted according to the method disclosed in Japanese Patent Application (OPI) No. 54029/78; or a dye may be previously bonded to a monomer which is rendered insoluble and dispersible upon polymerization as disclosed in Japanese Patent Publication No. 22955/69.

For the purpose of enhancing charging characteristics or improving image reproducibility, the liquid developer according to the present invention may contain, if desired, various additives as disclosed, e.g., by Yuji Harazaki, Denshi Shashin (Electrophotography), Vol. 16, No. 2, 44. For example, metals of di-2-ethylhexylsulfosuccinic acid, metal salts of naphthenic acid, metal salts of higher fatty acids, lecithin, polyvinylpyrrolidone, and the like can be used as charge controlling agents.

In the liquid developer according to the present invention, the insoluble resin particles composed mainly of the resin and, if desired, the colorant, are preferably present in an amount of from about 0.5 to about 50 parts by weight per 1,000 parts by weight of the carrier medium. Amounts less than about 0.5 part by weight result in insufficient image density, and amounts more than 50 parts readily cause fog formation on non-image areas. The resin soluble in the carrier medium, such as the above-described dispersion stabilizers, if any, are present in an amount of from about 0.5 to about 100 parts by weight per 1,000 parts by weight of the carrier medium. The above-described charge controlling agent is preferably used in an amount of from about 0.001 to about 1.0 part by weight per 1,000 parts by weight of the carrier medium.

The liquid developer of the present invention may further contain various additives according to necessity, with the total amount thereof being limited by electrical resistivity of the developer. More specifically, the amount of each additive should be controlling within such a range that the liquid developer from which the insoluble resin particles have been removed may have an electrical resistivity more than about $10^9\Omega\cdot$cm, because if such electrical resistivity is not more than about $10^9\Omega\cdot$cm, it becomes difficult to obtain an image of satisfactory continuous gradation.

The present invention will now be illustrated with reference to Examples and specific embodiments thereof, but it should be understood that these examples are not deemed to limit the present invention in any manner whatsoever. Unless otherwise indicated, all parts, percent, ratios and the like are by weight.

PREPARATION EXAMPLE 1

Preparation of Soluble Resin for Dispersion Stability (Compound (i))

A mixed solution consisting of 128.7 g of stearyl methacrylate, 2.6 g of 2-hydroxyethyl methacrylate, and 240 g of toluene was heated to 75° C. in a nitrogen stream, and 1.3 g of azobisisobutyronitrile was added thereto while stirring. After 6 hours, a Deen-Stark water separator was fixed to the reaction vessel, and 0.2 g of hydroquinone, 0.1 g of sulfuric acid, and 1.7 g of methacrylic acid were added to the reaction mixture. The temperature was elevated to 110° C. while stirring to allow the mixture to react until 65% of the methacrylic acid was consumed. After the reaction, the reaction mixture was poured into 4,000 g of methanol for re-precipitation to obtain a slightly yellow-colored powder. The resulting powder had a molecular weight of $17.8\times10^4$ as determined by high performance liquid chromatography (HPLC).

PREPARATION EXAMPLE 2

Preparation of Soluble Resin for Dispersion Stability (Compound (ii))

A mixture consisting of 93.6 g of lauryl methacrylate, 4.5 g of glycidyl methacrylate, and 230 g of toluene was heated to 85° C. in a nitrogen stream, and 1.0 g of benzoyl peroxide was added thereto while stirring. After 4 hours, the temperature was lowered to 40° C., and 0.2 g of hydroquinone, 0.2 g of lauryldimethylamine, and 2.8 g of methacrylic acid were added to the reaction mixture. The temperature was elevated up to 115° C. with stirring to allow the mixture to react until 55% of the methacrylic acid was consumed. After the reaction, the reaction mixture was poured into 4,000 g of methanol to cause re-precipitation to obtain a brown viscous product. The product had an average molecular weight of $15.0\times10^4$ as determined aby HPLC.

PREPARATION EXAMPLE 3

Preparation of Soluble Resin for Dispersion Stability (Compound (iii))

A mixture consisting of 130 g of stearyl acrylate, 1.4 g of methacrylic acid, and 240 g of toluene was heated to 85° C. in a nitrogen stream, and 1.3 g of benzoyl peroxide was added thereto while stirring. After 4 hours, the temperature was lowered to 40° C., and 0.2 g of hydroquinone, 0.2 g of lauryldimethylamine, and 2.0 g of glycidyl acrylate were added thereto. The temperature was elevated to 115° C. with stirring, and the mixture was allowed to react until 55% of the methacrylic acid was consumed. After the reaction, the reaction mixture was poured into 4,000 g of methanol for re-precipitation to obtain a slightly yellow-colored powder having an average molecular weight of $21.3\times10^4$.

PREPARATION EXAMPLE 4

Preparation of Soluble Resin for Dispersion Stability (Compound (iv))

The same procedure of Preparation Example 3 was repeated, except for replacing the stearyl methacrylate as used in Preparation Example 3 with 97.7 g of lauryl methacrylate to obtain a slightly brown-colored viscous substance. The product had an average molecular weight of $18.7\times10^4$.

PREPARATION EXAMPLE 5

Preparation of Soluble Resin for Dispersion Stability (Compound (v))

A mixture consisting of 121.9 g of stearyl methacrylate, 4.2 g of methacrylic chloride, and 300 g of toluene was heated to 75° C. in a nitrogen stream, and 1.2 g of azobisisobutyronitrile was added thereto while stirring. After 6 hours, 0.2 g of hydroquinone and 2.3 g of allylamine were added thereto. The temperature was elevated with stirring until the reaction solution was slowly refluxed, and the reaction was continued at that temperature for an additional 6 hours. After the reaction, the reaction mixture was poured into 4,000 g of methanol to cause re-precipitation to obtain a white powder. The powder had an average molecular weight of $24.7\times10^4$.

PREPARATION EXAMPLE 6

Preparation of Soluble Resin for Dispersion Stability (Compound (vi))

The same procedure of Preparation Example 5 was repeated, except for replacing the stearyl methacrylate with 91.6 g of lauryl methacrylate and replacing the allylamine with allyl alcohol to obtain a slightly brown-colored viscous substance having an average molecular weight of $1.28\times10^4$.

PREPARATION EXAMPLE 7

Preparation of Soluble Resin for Dispersion Stability (Compound (vii))

A mixed solution consisting of 28.5 g of glutaric anhydride, 32.5 g of 2-hydroxyethyl methacrylate, 0.5 ml of sulfuric acid, and 50 ml of benzene was stirred at room temperature. An increase in the liquid temperature appeared after about 30 minutes, and the stirring was continued for 2 hours while naturally refluxing the mixture. The reaction mixture was washed with water and dried. The solvent was removed from the residue under reduced pressure to obtain a product substantially composed of a single compound. If desired, the product may be purified by silica gel column chromatography.

A mixture consisting of 8.8 g of the thus prepared monomer, 123.2 g of stearyl methacrylate, and 240 g of toluene was heated to 75° C. in a nitrogen stream, and 1.2 g of azobisisobutyronitrile was added thereto while stirring. After 6 hours, 0.2 g of hydroquinone, 0.2 g of lauryldimethylamine, and 5.1 g of glycidyl methacrylate were added to the mixture. The temperature was elevated to 110° C. while stirring to allow the mixture to react until 70% of the carboxylic acid derived from the monomer used was consumed. After the reaction, the reaction mixture was poured into 4,000 g of methanol for re-precipitation to obtain a white powder having an average molecular weight of $28.7\times10^4$.

PREPARATION EXAMPLE 8

Preparation of Soluble Resin for Dispersion Stability (Compound (viii))

The same procedure of Preparation Example 7 was repeated, except for replacing the stearyl methacrylate with 92.6 g of lauryl methacrylate, replacing the glycidyl methacrylate with 2.1 g of allylamine, and replacing the lauryldimethylamine with 0.1 g of sulfuric acid to obtain a colorless, transparent, and viscous substance. This product had an average molecular weight of $25.3\times10^4$.

PREPARATION EXAMPLE 9

Preparation of Resin Particles

A mixed solution consisting of 18.5 of the soluble resin for dispersion stability as prepared in Preparation Example 1, 8 g of Compound (1) as monomer (E), 150 g of vinyl acetate, and 320 g of Shellsol 70 was heated to 70° C. in a nitrogen stream, and 2 g of azobisisovaleronitrile were added thereto as a polymerization initiator. A white turbidity began to appear after about 50 minutes from the addition of the polymerization initiator, and the temperature of the reaction mixture rose up to 86° C. After 2 hours, an additional one gram of azibisisovaleronitrile was added to the reaction mixture, and the reaction was further continued for 1 hour. After cooling, the reaction mixture was passed through cloth of 200 mesh to obtain a white dispersion having a mean particle size of 0.30 μm.

PREPARATION EXAMPLE 10

Preparation of Resin Particles

A mixed solution consisting of 36 g of the soluble resin as prepared in Preparation Example 2, 20 g of Compound (2) as monomer (E), 200 g of vinyl acetate, and 470 g of Isoper H was heated to 70° C. in a nitrogen stream, and 4 g of azobisisobutyronitrile was added thereto as a polymerization initiator while stirring. After about 30 minutes from the addition of the polymerization initiator, a white turbidity appeared, and the temperature of the reaction mixture rose to 90° C. After 1.5 hours, an additional 2 g of azobisisovaleronitrile were added to the reaction system, and the reaction was continued for 1.5 hours. After cooling, the reaction mixture was passed through cloth of 200 mesh to obtain a white latex having an average particle size of 0.19 μm.

PREPARATION EXAMPLE 11

Preparation of Resin Particles

A mixed solution consisting of 20 g of the soluble resin as obtained in Preparation Example 3, 0.8 g of Compound (2) as monomer (E), 80 g of vinyl acetate, and 490 g of Shellsol 70 was heated to 70° C. in a nitrogen stream, and 2.5 g of azobisisovaleronitrile were added thereto while stirring. A white turbidity appeared after about 15 minutes from the addition of the polymerization initiator, and the temperature of the reaction mixture rose to 80° C. After one hour, 2.5 g of azobisisovaleronitrile were further added thereto, and the reaction was continued for an additional 2 hours. After cooling, the reaction mixture was passed through cloth of 200 mesh to obtain a white latex having an average particle size of 0.21 μm.

PREPARATION EXAMPLE 12

Preparation of Resin Particles

A mixed solution consisting of 50 g of the soluble resin as obtained in Preparation Example 4, 25 g of Compound (5) as monomer (E), 500 g of vinyl acetate, and 1,500 g of Shellsol 70 was heated to 70° C. in a nitrogen stream, and 5 g of azobisisovaleronitrile were added thereto under stirring. A white turbidity appeared after about 30 minutes from the addition of the polymerization initiator, and the temperature of the reaction mixture rose to 85° C. After 2 hours, 2.5 g of azobisisovaleronitrile were further added to the mixture, and the reaction was continued for an additional one hour. After cooling, the reaction mixture was passed through cloth of 200 mesh to obtain a white latex having an average particle size of 0.25 μm.

PREPARATION EXAMPLE 13

Preparation of Resin Particles

A mixed solution consisting of 12 g of the soluble resin as obtained in Preparation Example 5, 5 g of Compound (5) as monomer (E), 100 g of vinyl acetate, and 210 g of Shellsol 70 was heated to 70° C. in a nitrogen stream, and 0.9 g of azobisisovaleronitrile were added thereto under stirring. After about 50 minutes from the addition of the polymerization initiator, a white turbidity appeared, and the temperature of the reaction mixture rose to 82° C. After 2.5 hours, 0.45 g of azobisisovaleronitrile were further added thereto, and the reaction was continued for an additional one hour. After cooling, the reaction mixture was passed through cloth of 200 mesh to obtain a white latex having an average particle size of 0.35 μm.

PREPARATION EXAMPLE 14

Preparation of Resin Particles

A mixed solution consisting of 15 g of the soluble resin as obtained in Preparation Example 6, 18 g of Compound (4) as monomer (E), 150 g of vinyl acetate, and 230 g of Shellsol 70 was heated to 70° C. in a nitrogen stream, and 4 g of azobisisovaleronitrile were added thereto while stirring. A white turbidity began to appear after about 20 minutes from the addition of the polymerization initiator, and the temperature of the reaction mixture rose to 90° C. After 2 hours, 1 g of azobisisovaleronitrile were further added thereto, and the reaction was continued for an additional one hour. After cooling, the reaction mixture was passed through cloth of 200 mesh to obtain a white latex having an average particle size of 0.28 μm.

PREPARATION EXAMPLE 15

Preparation of Resin Particles

A mixed solution consisting of 30 g of the soluble resin as obtained in Preparation Example 7, 10 g of Compound (10) as monomer (E), 200 g of vinyl acetate, and 800 g of Isoper H was heated to 70° C. in a nitrogen stream, and 2 g of azobisisovaleronitrile were added thereto while stirring. After about 40 minutes from the addition of the polymerization initiator, a white turbidity appeared, and the temperature rose to 85° C. After 2 hours, 1.8 g of azobisisovaleronitrile were further added thereto, and the reaction was continued for an additional 2 hours. After cooling, the reaction mixture was passed through cloth of 200 mesh to obtain a white latex having an average particle size of 0.24 μm.

PREPARATION EXAMPLE 16

Preparation of Resin Particles

A mixed solution consisting of 50 g of the soluble resin as prepared in Preparation Example 8, 25 g of Compound (10) as monomer (E), 250 g of vinyl acetate, and 840 g of Shellsol 70 was heated to 70° C. in a nitrogen stream, and 12.5 g of azobisisovaleronitrile were added thereto while stirring. After about 30 minutes from the addition of the polymerization initiator, a white turbidity began to appear, and the liquid temperature rose up to 92° C. After 2.5 hours, 2.5 g of azobisisovaleronitrile were further added thereto, and the reaction was continued for an additional 0.5 hour. After cooling, the reaction mixture was passed through cloth of 200 mesh to obtain a white latex having an average particle size of 0.32 μm.

PREPARATION EXAMPLE 17

Preparation of Resin Particles

A mixed solution consisting of 22.5 g of the soluble resin as obtained in Preparation Example 8, 4.5 g of Compound (11) as monomer (E), 150 g of vinyl acetate, and 600 g of Isoper H was heated to 70° C. in a nitrogen stream, and 1.35 g of azobisisovaleronitrile were added to the solution while stirring. After about 40 minutes from the addition of the polymerization initiator, a white turbidity appeared, and the liquid temperature rose up to 81° C. After 2 hours, 0.9 g of azobisisovaleronitrile were further added to the reaction mixture, and the reaction was continued for an additional 1.5 hours. After cooling, the reaction mixture was passed through cloth of 200 mesh to obtain a white latex having an average particle size of 0.25 μm.

COMPARATIVE PREPARATION EXAMPLE 1

Preparation of Resin Particles

The same procedure of Preparation Example 9 was repeated, except for replacing Compound (1) with 8 g of lauryl methacrylate to prepare a latex having an average particle size of 0.29 μm.

COMPARATIVE PREPARATION EXAMPLE 2

Preparation of Resin Particles

The same procedure of Preparation Example 9 was repeated, except for replacing Compound (1) with 8 g of stearyl methacrylate to prepare a latex having an average particle size of 0.30 μm.

EXAMPLE 1

Ten grams of polylauryl methacrylate, 10 g of Nigrosine, and 30 g of Shellsol 71 were placed in a paint shaker (manufactured by Tokyo Seiki K.K.) together with glass beads, and the mixture was dispersed for 90 minutes to obtain a fine dispersion of Nigrosine.

A mixture comprising 30 g of the latex as obtained in Preparation Example 9, 2.5 g of the above obtained Nigrosine dispersion, and 0.05 g of an octadecene/-maleic semioctadecylamide copolymer were diluted with 1 l of Shellsol 71 to prepare a liquid developer for electrostatic photography. This liquid developer was designated as Liquid Developer A.

For comparison, Liquid Developers B and C were prepared in the same manner as for Developer A, except for using the resin dispersion obtained in Comparative Preparation Examples 1 and 2, respectively, in place of that of Preparation Example 1.

An electrophotographic light-sensitive material, ELP Master II type (produced by Fuji Photo Film Co., Ltd.) was exposed to light and developed by means of an automatic plate making machine, ELP 560V (manufactured by Fuji Photo Film Co., Ltd.), using each of Liquid Developers A, B and C to obtain an offset master plate having a large size of 560 mm×700 mm. Further, 2,000 sheets of the same light-sensitive materials of the same size were processed in the same manner, and adhesion of the toner onto the developing machine was observed.

The resulting offset master plate was mounted on a printer for large-sized prints, SOR-KZ (manufactured by Heidelberg Co.) to carry out printing with the printing pressure being fixed at about 30% higher than a normal level, and the occurrence of printing defects, such as a blur of letters, was observed. The results of these observations are shown in Table 1 below.

TABLE 1

| Liquid Developer | Adhesion to Developing Machine | Occurrence of Blur of Letters |
|---|---|---|
| A | not observed | not observed in more than 10,000 prints |
| B | not observed | observed on the 7,000th prints |
| C | not observed | observed on the 7,000th prints |

As can be seen from the results of Table 1, the liquid developer using the resin particles according to the present invention provides a master plate having markedly improved printing durability without causing contamination of a developing machine. These results also show that the liquid developer forms an image excellent in printing durability even on a large-sized sheet.

EXAMPLE 2

A mixture of 100 g of the white latex as prepared in Preparation Example 10 and 1.5 g of Sumikaron Black (produced by Sumitomo Chemical Co., Ltd.) was heated to 100° C. for 4 hours while stirring. After cooling to room temperature, any remaining dye was removed by passing the mixture through nylon cloth of 200 mesh to thereby obtain a black resin dispersion having an average particle size of 0.20 μm.

The resulting black resin dispersion (32 g) and 0.05 g of zirconium naphthenate were diluted with 1 l of Shellsol 71 to prepare a liquid Developer.

When development was carried out using the resulting developer in the same manner as described in Example 1 to obtain 2,000 plates, no contamination of the developing machine due to adhesion of toner particles was observed. Further, the resulting master plate for offset printing had a clear image, and the image of the print after printing 10,000 sheets was also very clear.

EXAMPLE 3

A mixture of 100 g of the white latex as prepared in Preparation Example 11 and 3 g of Victoria Blue B was heated to 70° to 80° C., followed by stirring for 6 hours. After cooling to room temperature, any remaining dye was removed by passing the mixture through nylon cloth of 200 mesh to obtain a blue resin dispersion having an average particle size of 0.20 μm.

The resulting blue resin dispersion (32 g) and 0.05 g of zirconium naphthenate were diluted with 1 l of Isoper H to prepare a liquid developer.

When development was carried out using the resulting developer in the same manner as described in Example 1 to obtain 2,000 plates, no contamination of the developing machine due to adhesion of toner particles was observed. Further, the resulting master plate for offset printing had a clear image, and the image of the print after printing 10,000 sheets was also very clear.

EXAMPLE 4

The white latex as prepared in Preparation Example 15 (32 g), 2.5 g of the Nigrosine dispersion as prepared in Example 1, and 0.02 g of a semidocosanylamide of a diisobutylene/maleic anhydride copolymer were diluted with 1 l of Isoper G to prepare a liquid developer.

When development was carried out using the resulting developer in the same manner as in Example 1, no contamination of the developing machine due to adhesion of toner particles was observed. Further, the resulting master plate for offset printing had a clear image, and the image of the print after printing 10,000 sheets was also clear.

Furthermore, when the liquid developer as obtained above was allowed to stand for 3 months and then subjected to development processing in the same manner as above, the results observed were equal to those obtained when the developer was used immediately after its preparation.

EXAMPLE 5

Ten grams of polydecyl methacrylate, 30 g of Isoper H, and 8 g of Alkali Blue were placed in a paint shaker together with glass beads, and the mixture was dispersed for 2 hours to obtain a fine dispersion of Alkali Blue.

The white latex as obtained in Preparation Example 17 (30 g), 4.2 g of the above prepared Alkali Blue dispersion, and 0.02 g of semidocosanylamide of a diisobutylene/maleic anhydride copolymer were diluted with 1 l of Isoper G to prepare a liquid developer.

When development was carried out using the resulting developer in the same manner as in Example 1, no contamination of the developing machine due to adhesion of toner particles was observed. The resulting master plate for offset printing had a very clear image, and the image of the print after printing 10,000 sheets was also very clear.

EXAMPLE 6

A mixture of 100 g of the white latex as obtained in Preparation Example 9, 1.5 g of Sumikaron Black, and 14 g of vinyl acetate was heated to 100° C. for 2 hours while stirring. Then, the reflux condenser was removed from the reaction vessel at the same temperature, and the stirring was continued for 3 hours to remove the solvent by distillation. After cooling to room temperature, the residue was passed through nylon cloth of 200 mesh to remove any remaining dye to obtain a black resin dispersion having an average particle size of 0.20 μm.

The resulting black resin dispersion (32 g) and 0.03 g of a 1-octadecene/N-octadecylmaleamic acid copolymer were diluted with 1 l of Shellsol 71 to prepare Liquid Developer D.

For comparison, Liquid Developers E and F were prepared in the same manner as for Liquid Developer D, except for using the latex prepared in Comparative Preparation Examples 1 and 2, respectively, in place of the white latex of Preparation Example 9.

ELP Master II type was exposed to light and developed in the same manner as in Example 1, except for using each of Liquid Developers D, E and F in place of Liquid Developer A, B or C, respectively, and contamination of the developing machine due to adhesion of the toner and the occurrence of a blur of letters were observed. The results obtained are shown in Table 2 below.

TABLE 2

| Liquid Developer | Adhesion to Developing Machine | Occurrence of Blur of Letters |
|---|---|---|
| D | not observed | not observed in more than 10,000 prints |
| E | not observed | observed on the 7,000th prints |
| F | not observed | observed on the 7,000th prints |

It can be seen that the liquid developer using the resin particles according to the present invention provides a master plate having markedly improved printing durability without causing contamination of a developing machine. It can also be seen that the liquid developer of the present invention forms an image excellent in printing durability even on a large-sized sheet.

EXAMPLE 7

A mixture consisting of 100 g of a white latex obtained in Preparation Example 10, 1.5 g of Sumikaron Navy Blue, and 15 g of vinyl acetate was heated to 100° C. and stirred for 1.5 hours under heating. Thereafter, the reflux condenser was removed from the reaction vessel, and the stirring was continued for an additional 4 hours to remove the solvent by distillation. After cooling to room temperature, the residue was passed through nylon cloth of 200 mesh to remove any remaining dye to obtain a blue resin dispersion having an average particle size of 0.2 μm.

The resulting resin dispersion (30 g) and 0.04 g of a diisobutylene/N-octadecylmaleamic acid copolymer were dispersed in 1 l of Shellsol 71 to prepare a liquid developer for electrostatic photography.

Development was carried out using the resulting liquid developer in the same manner as in Example 1. Contamination of the developing machine due to adhesion of the toner particle was not observed at all even after development of 2,000 sheets. The image of the resulting master plate for offset printing was clear, and the image of the print after obtaining 10,000 prints was also very clear.

EXAMPLE 8

A mixture consisting of 100 g of the white latex prepared in Preparation Example 11, 3 g of Aizen Basic Cyanine 6GHB, and 15 g of ethanol was heated to a temperature of 70° to 80° C., followed by stirring for 2 hours. The mixture was further stirred at that temperature for 2 hours while reducing pressure by means of an aspirator. After cooling, the reaction mixture was passed through nylon cloth of 200 mesh to remove any remaining dye to obtain a blue resin dispersion having an average particle size of 0.18 μm.

The resulting blue resin dispersion (32 g) and 0.04 g of a semioctadecylamide of a 1-octadene/maleic acid copolymer were dispersed with 1 l of Isoper H to prepare a liquid developer.

When development was carried out using the resulting liquid developer in the same manner as in Example 1, no contamination of the developing machine due to adhesion of the toner particles was not observed, even after development of 2,000 sheets. Further, the image of the resulting master plate for offset printing was clear, and the image of the print after obtaining 10,000 prints was also very clear.

EXAMPLES 9 TO 12

Liquid developers were prepared in the same manner as in Example 8, except for replacing Aizen Basic Cyanine 6GHB with each of Aizen Cathilo Yellow 3GLH (Hodogaya Chemical Co., Ltd.) (Example 9), aizen Astra Phloxine FF (Hodogaya Chemical Co., Ltd.) (Example 10), Aizen Cathilon Pink FGH (Hodogaya Chemical Co., Ltd.) (Example 11), and Methylene Blue (Example 12).

When development was carried out in the same manner as in Example 1, except for using each of the resulting liquid developers, the results obtained were substantially equal to those of Example 8.

EXAMPLE 13

To 100 g of the white latex obtained in Preparation Example 15 were added 0.50 g of Kayalon Fast Brown R (Nippon Kayaku Co., Ltd.), 0.15 g of Miketon Fast Pink FR (Mitsui Chemical Co., Ltd.), 1.05 g of Victoria Blue B, and 16 g of vinyl acetate, and the mixture was stirred at 90° C. for 2 hours. After the reflux condenser was removed from the reaction vessel, the stirring was further continued for an additional 2 hours. After cooling to room temperature, the reaction mixture was passed through nylon cloth of 200 mesh to obtain a black resin dispersion having an average particle size of 0.18 μm.

The resulting black resin dispersion (32 g) and 0.03 g of an octadecyl vinyl ether/N-octadecylmaleamic acid copolymer were diluted with 1 l of Isoper G to prepare a liquid developer.

When development was carried out in the same manner as in Example 1 using the resulting liquid developer, no contamination of the developing machine due to adhesion of the toner particles was observed at all even after development of 2,000 sheets. Further, the image of the resulting master plate for offset printing was clear, and the image of the print after obtaining 10,000 prints was also very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising a carrier medium having an electrical resistivity of not less than $10^9$ Ω·cm and a dielectric constant of not more than 3.5 having dispersed therein at least a resin, wherein said resin is a copolymer resin obtained by copolymerizing (1) a solution containing at least one copolymer having an unsaturated bond obtained by copolymerizing at least one monomer (A) represented by formula (I) shown below and at least one monomer (B) represented by formula (II) shown below, and reacting the resulting copolymer with at least one monomer (C) represented by formula (III) shown below, (2) at least one monomer (D) which is soluble in the carrier medium but becomes insoluble upon polymerization, and (3) at least one monomer (E) represented by formula (IV) shown below to obtain a resin dispersion:

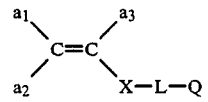
(I)

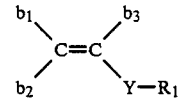
(II)

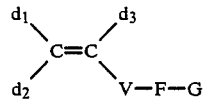
(III)

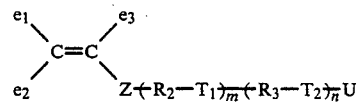
(IV)

wherein $a_1$, $a_2$, $a_3$, $b_1$, $b_2$, $b_3$, $d_1$, $d_2$, $d_3$, $e_1$, $e_2$, and $e_3$, which may be the same or different, each represents a hydrogen atom, a hydrocarbon group, $—CO_2J$ or $—CH_2CO_2J$, wherein J represents a hydrogen atom or a hydrocarbon group; X, Y, V and Z, which may be the same or different, each represents —O—, —S—, —CO—, $—CO_2—$, —OCO—, $—SO_2—$, $—CH_2OCO—$, —CONH—, $—SO_2NH—$, —NHCO—, —NHCONH—,

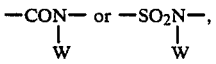

wherein W represents a hydrocarbon group or $-(R_2—T_1)_m(R_3—T_2)_nU$; L and F, which may be the same or different, each represents a hydrocarbon group or a chemical bond linking X and Q, or V and G, respectively, either directly or via a hetero atom; Q and G, which may be the same or different, each represents a group selected from $—CO_2H$,

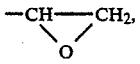

—COCl, —OH, $—NH_2$, $—NHR_4$, wherein $R_4$ represents a hydrocarbon group, or —NCO, Q and G thus being capable of forming a chemical bond upon reaction; $R_1$ represents a hydrocarbon group having from 4 to 20 carbon atoms; U represents a hydrogen atom, an unsubstituted hydrocarbon group having up to 18 carbon atoms or a hydrocarbon group having up to 18 carbon atoms which may be substituted with a halogen atom, —OH, —CN, $—NH_2$, $—CO_2H$, $—SO_3H$ or $—PO_3H$; $T_1$ and $T_2$, which may be the same or different, each represents —O—, —S—, —CO—, $—CO_2—$, —OCO—, $—SO_2—$,

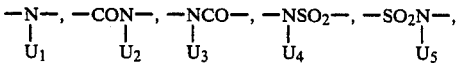

—$NHCO_2$— or —NHCONH—, wherein $U_1$, $U_2$, $U_3$, $U_4$, and $U_5$ each has the same meaning as U; $R_2$ and $R_3$, which may be the same or different, each represents a substituted or unsubstituted hydrocarbon group having up to 18 carbon atoms which may contain in its main chain a group $$-\underset{\underset{T_3\leftarrow R_5-T_4\rightarrow_p U_6}{|}}{CH}-,$$

wherein $T_3$ and $T_4$, which may be the same or different, each has the same meaning as $T_1$ and $T_2$; $R_5$ represents a substituted or unsubstituted hydrocarbon group having up to 18 carbon atoms; $U_6$ has the same meaning as U; and p represents 0 or an integer of from 1 to 4; and m and n each represents 0 or an integer of from 1 to 4.

2. A liquid developer as claimed in claim 1, wherein Z represents —O—, —COO—, —OCO—, —$CH_2OCO$—, —CONH— or $$-\overset{\overset{W}{|}}{CON}-,$$

wherein W represents a substituted or unsubstituted alkyl group having from 1 to 16 total carbon atoms, a substituted or unsubstituted alkenyl group having from 2 to 16 total carbon atoms, a substituted or unsubstituted alicyclic group having from 5 to 18 total carbon atoms or a group $-R_2-T_1)_m(R_3-T_2)_nU$; U represents a hydrogen atom or an aliphatic group having up to 16 carbon atoms which may be substituted with a halogen atom, —OH, —CN or —COOH; $T_1$ and $T_2$ each represents —O—, —S—, —CO—, —COO—, —OCO—, $$-\overset{\overset{U_2}{|}}{CON}- \quad \text{or} \quad -\overset{\overset{U_3}{|}}{NCO}-,$$

wherein $U_2$ and $U_3$ each has the same meaning as U as defined above; $R_2$ and $R_3$ each represents a substituted or unsubstituted hydrocarbon group having up to 12 carbon atoms which may contain in its main chain a group $$-\underset{\underset{T_3\leftarrow R_5-T_4\rightarrow_p U_6}{|}}{CH}-;$$

$T_3$ and $T_4$ each has the same meaning as $T_1$ and $T_2$ as defined above; $R_5$ represents an alkylene group, an alkenylene group or an aralkylene group having up to 12 carbon atoms; $U_6$ has the same meaning as U as defined above; $e_1$, $e_2$ and $e_3$ each represents a hydrogen atom, a methyl group, —$CO_2J$ or —$CH_2CO_2J$, wherein J represents a hydrogen atom, an alkyl group, an alkenyl group, an aralkyl group or a cycloalkyl group having up to 18 carbon atoms; and m, n and p each represents 0 or an integer of from 1 to 3.

3. A liquid developer as claimed in claim 2, wherein Z represents —COO—, —CONH— or $$-\overset{\overset{W}{|}}{CON}-;$$

$e_1$, $e_2$ and $e_3$ each represents a hydrogen atom, a methyl group, —$CO_2J$ or —$CH_2CO_2J$, wherein J represents an alkyl group having from 1 to 12 carbon atoms; $R_2$ and $R_3$ each represents a group selected from $$-\overset{\overset{R'}{|}}{\underset{\underset{R''}{|}}{C}}-$$

(wherein R′ and R″ each represents a hydrogen atom, an alkyl group, an alkyl group or a halogen atom), —CH=CH—,

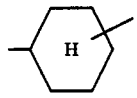

, and $-\underset{\underset{T_3\leftarrow R_5-T_4\rightarrow_p U_6}{|}}{CH}-$ (wherein $T_3$, $T_4$, $U_6$, $R_5$ and p are as defined in claim 2); and the total number of carbon atoms contained in Z, $R_2$, $T_1$, $R_3$, $T_2$ and U is 8 or more.

4. A liquid developer as claimed in claim 1, wherein the molar ratio of said monomer (A) to said monomer (B) is from about 50:50 to about 0.5:95.5.

5. A liquid developer as claimed in claim 1, wherein the molar ratio of said monomer (A) to said monomer (C) is from about 2:3 to about 2:1.

6. A liquid developer as claimed in claim 1, wherein said monomer (D) is present in a total amount of from about 5 to about 80 parts by weight per 100 parts by weight of a non-aqueous solvent in said solution.

7. A liquid developer as claimed in claim 1, wherein said monomer (E) is used in a total amount of from about 0.1 to about 50 mol% based on the total amount of said monomer (D).

8. A liquid developer as claimed in claim 1, wherein said copolymer having an unsaturated bond used in said step (2) is used in a total amount of from about 1 to about 100 parts by weight per 100 parts by weight of the total monomers.

9. A liquid developer as claimed in claim 1, wherein said copolymer resin is present in an amount of from about 0.5 to about 50 parts by weight per 1,000 parts by weight of said carrier medium.

10. A liquid developer as claimed in claim 1, wherein said liquid developer is a colored liquid developer and said copolymer resin is a colored copolymer resin obtained by adding at least one organic dye to said resin dispersion and heating.

11. A liquid developer as claimed in claim 10, wherein said heating is carried out in the presence of a second solvent.

12. A liquid developer as claimed in claim 11, wherein said second solvent is at least one of the monomers constituting said copolymer resin.

13. A liquid developer as claimed in claim 11, wherein said second solvent is present in an amount of at least about 1/10 the weight of resin particles in said resin dispersion.

14. A liquid developer as claimed in claim 11, wherein said organic dye is added in an amount of from about 0.5 to about 20% by weight based on resin particles in said dispersion.

15. A liquid developer as claimed in claim 11, wherein said heating is carried out at a temperature of from about 40° to about 150° C. for about 0.5 to about 12 hours.

16. A liquid developer as claimed in claim 1, wherein said monomer (A) and said monomer (B) are dissolved in a solvent, and a resulting solution is heated at a temperature of from about 50° to 200° C. for 2 to 12 hours in the presence of a polymerization initiator, and said monomer (C) is added thereto, and a resulting mixture is heated at a temperature of from about 50° to 200° C. for an additional 2 to 48 hours.

17. A liquid developer as claimed in claim 1, wherein said copolymer having an unsaturated bond has a molecular weight of from about 5,000 to 500,000.

18. A liquid developer as claimed in claim 1, wherein said monomer (D) is selected from the group consisting of alkyl esters of unsaturated carboxylic acids, vinyl esters or allyl esters of aliphatic carboxylic acids, unsaturated carboxylic acids or anhydrides thereof, 2-hydroxyethyl acrylate, 2-hydroxyethyl methacrylate, N-vinylpyrrolidone, acrylonitrile, and vinyl ethers.

19. A liquid developer as claimed in claim 1, wherein said copolymer having an unsaturated bond, said monomer (D) and said monomer (E) are dissolved in a non-aqueous solvent and heated at a temperature of from about 50° to 200° C. about 2 to about 10 hours in the presence of a polymerization initiator.

* * * * *